US009111432B2

(12) United States Patent
Jarman et al.

(10) Patent No.: US 9,111,432 B2
(45) Date of Patent: Aug. 18, 2015

(54) MOBILE DURESS DYNAMIC REGISTRATION AND PENDANT MANAGEMENT SYSTEM

(71) Applicants: Mark Wayne Jarman, Lousiville, CO (US); Michael Kenneth Slack, Broomfield, CO (US); Donald Leo Commare, Broomfield, CO (US); Eric Scott Roth, Broomfield, CO (US); Craig Scott Dever, Lafayette, CO (US); Carol Theresa Markert, Brighton, CO (US); Roland Eugene Brown, Brighton, CO (US); William Neal Shurmantine, Lafayette, CO (US); Daryl Thomas Burkard, Erie, CO (US); Christian Huber, Louisville, CO (US); Harry Baylor Taylor, Lafayette, CO (US); Sean Lewis, Littleton, CO (US); Rashid Al-hamoodah, Longmont, CO (US)

(72) Inventors: Mark Wayne Jarman, Lousiville, CO (US); Michael Kenneth Slack, Broomfield, CO (US); Donald Leo Commare, Broomfield, CO (US); Eric Scott Roth, Broomfield, CO (US); Craig Scott Dever, Lafayette, CO (US); Carol Theresa Markert, Brighton, CO (US); Roland Eugene Brown, Brighton, CO (US); William Neal Shurmantine, Lafayette, CO (US); Daryl Thomas Burkard, Erie, CO (US); Christian Huber, Louisville, CO (US); Harry Baylor Taylor, Lafayette, CO (US); Sean Lewis, Littleton, CO (US); Rashid Al-hamoodah, Longmont, CO (US)

(73) Assignee: Inovonics Wireless Corporation, Louisville, CO (US)

( * ) Notice: Subject to any disclaimer, the term of this patent is extended or adjusted under 35 U.S.C. 154(b) by 191 days.

(21) Appl. No.: 13/790,812
(22) Filed: Mar. 8, 2013
(65) Prior Publication Data

US 2013/0257613 A1 Oct. 3, 2013

Related U.S. Application Data

(60) Provisional application No. 61/616,190, filed on Mar. 27, 2012.

(51) Int. Cl.
*G08B 1/08* (2006.01)
*G08B 25/01* (2006.01)

(52) U.S. Cl.
CPC ..... *G08B 25/016* (2013.01)

(58) Field of Classification Search
None
See application file for complete search history.

(56) References Cited

U.S. PATENT DOCUMENTS 6,774,840 B1 8/2004 Adamczyk et al.
7,171,187 B2 1/2007 Haave et al.

(Continued)

FOREIGN PATENT DOCUMENTS

GB 2 193 359 A 2/1988

OTHER PUBLICATIONS

New Zealand First Examination Report issued on Mar. 21, 2013 in corresponding New Zealand IP No. 608194.

(Continued)

*Primary Examiner* — Travis Hunnings
(74) *Attorney, Agent, or Firm* — Caesar Rivise, PC

(57) ABSTRACT

A system for transmitting information in a wireless network includes at least one mobile transponder, each transponder adapted to be on the person of a user; an area controller gateway for controlling and managing the network, the area controller gateway operatively connected to the at least one mobile transponder; and a central monitoring station adapted to receive information from the at least one mobile transponder via the area controller gateway and to transmit other information to the at least one mobile transponder via the area controller gateway. The central monitoring station is operatively connected to the area controller gateway by an interne or cellular connection. The system may include a repeater adapted to receive information from the at least one mobile transponder and to transmit said information to the area controller gateway. The mobile transponder may be a duress pendant to provide duress notification or coverage to the user.

16 Claims, 5 Drawing Sheets

(56) References Cited

U.S. PATENT DOCUMENTS

| | | | | |
|---|---|---|---|---|
| 7,367,497 | B1 | 5/2008 | Hill | |
| 7,616,110 | B2 | 11/2009 | Crump et al. | |
| 8,378,811 | B2 | 2/2013 | Crump et al. | |
| 2003/0027547 | A1 | 2/2003 | Wade | |
| 2003/0050038 | A1 | 3/2003 | Haave et al. | |
| 2004/0174264 | A1 | 9/2004 | Reisman et al. | |
| 2004/0207523 | A1 | 10/2004 | Powell et al. | |
| 2005/0280543 | A1* | 12/2005 | Herbert | 340/572.8 |
| 2009/0181638 | A1* | 7/2009 | Gottlieb | 455/404.1 |
| 2009/0203350 | A1 | 8/2009 | Gottlieb | |
| 2009/0322513 | A1* | 12/2009 | Hwang et al. | 340/539.12 |
| 2009/0322548 | A1* | 12/2009 | Gottlieb | 340/686.6 |
| 2010/0317316 | A1 | 12/2010 | Lalos | |
| 2011/0007468 | A1 | 1/2011 | Burton et al. | |
| 2011/0136466 | A1* | 6/2011 | Pan | 455/404.2 |
| 2011/0140882 | A1* | 6/2011 | Jang | 340/539.13 |

OTHER PUBLICATIONS

Search Report for Great Britain Application No. GB1304796.4 issued Aug. 22, 2013.

* cited by examiner

MOBILE DURESS DYNAMIC REGISTRATION AND PENDANT MANAGEMENT SYSTEM

CROSS-REFERENCE TO RELATED APPLICATIONS

This application claims priority benefit of U.S. provisional Patent Application No. 61/616,190, filed Mar. 27, 2012, titled Mobile Duress Dynamic Registration and Pendant Management System, the entire disclosure of which is hereby expressly incorporated by reference herein.

BACKGROUND

Applicants' systems and methods relate to systems and methods for transmitting information in a wireless network wherein a central monitoring station is operatively connected to an IP network coordinator by an internet connection or a cellular connection. Applicants' systems and methods have particular application for mobile duress call systems and methods in which mobile transponders in the form of duress pendants are worn by users to provide duress coverage to the users, including but not limited to enterprise mobile duress extended coverage and remote coverage.

Conventional deployed technology requires that pendants be registered to the facilities' alarm panels, usually through keypad programming. This poses many problems, including causing a trouble condition on the alarm panel when a pendant leaves the premises. This usually also results in an undesired notification to the central monitoring station, resulting in a "cry wolf" condition, rendering the supervision capability nearly useless at worst, and a dangerous and distracting nuisance at best. Furthermore, for people who would visit multiple locations, they would have to A) have a separate pendant for each location to satisfy the pendant supervision, or B) leave all the panels in the trouble state when they are not present, or C) leave all pendants onsite, leaving personnel without a duress capability when entering or departing a premise. Sometimes this is overcome by turning off the supervision of the pendant, but this results in the pendant's "state of health" being unknown, and the protected person not knowing if they are protected with a working device and network, and provides no notification if the pendant leaves the premises.

Mobile duress pendants by nature are on the move. In one application, the pendants are assigned to employees and it is desirable that the pendants can leave the wireless network when the employees leave the network to go home, for example. An intrusion control panel can be used to monitor the pendants. Since an intrusion control panel is designed to report trouble when a pendant leaves the network, this imposes some limitations on the application of mobile duress pendants. Usually this results in the employee leaving the pendant in the facility when they leave, offering no protection outside the building. This is a major problem for banks, as one of the most vulnerable points is during a branch opening, referred to as a "morning glory robbery," before the employee enters the bank.

A conventional method for the self test of pendants is to put the control panel that they are connected to in the test mode and test all of the pendants at once. Doing so requires a call to a central monitoring station to advise them that the system is in test mode so that they ignore the alarms. Then the button on every pendant needs to be activated to ensure that they are tested. The user then records which pendants where activated and confirms that the central monitoring station received the alarm. This is a time consuming process for the user at the location. Usually, this test is done weekly or monthly and requires that all the pendants be on site and leaves the bank (or other facility) vulnerable as all security systems are temporarily off line.

BRIEF SUMMARY

There are various aspects of Applicants' systems and methods and many variations of each aspect.

One aspect is a system for transmitting information in a wireless network. The system includes at least one mobile transponder, an area controller gateway for controlling and managing the wireless network, and a central monitoring station. Each transponder is adapted to be on a person of a user. The area controller gateway is operatively connected to the at least one mobile transponder. The central monitoring station is adapted to receive information from the at least one mobile transponder via the area controller gateway and to transmit other information to the at least one mobile transponder via the area controller gateway. The central monitoring station is operatively connected to the area controller gateway by an interne connection or a cellular connection.

In a first variation of the system, the mobile transponder is a mobile two-way transponder. In a second variation of the system, the at least one mobile transponder includes at least one mobile one-way transponder, and the system includes a local control and configuration device operatively connected to the at least one mobile one-way transponder.

In a third variation of the system, the area controller gateway receives an alarm from the mobile transponder and uses an algorithm to determine a location of the transponder transmitting the alarm.

In a fourth variation of the system, the mobile transponder is a duress pendant worn by the user to provide a duress coverage to the user. There are many variants of this fourth variation of the system.

In one variant of the fourth variation of the system, the duress coverage is provided at a first location and is extended to a second location and also to an area between the first location and the second location by use of at least one repeater.

In a second variant of the fourth variation of the system, the duress coverage is extended for a user traveling in a vehicle over an area surrounding the vehicle by use of an on-board GPS system, whereby information is transmitted from the vehicle to the central monitoring station by a cellular connection with a GPS location, wherein the area controller gateway is mounted on the vehicle.

In a third variant of the fourth variation of the system, the duress pendant includes an access control device and is adapted to provide a security credential.

In a fourth variant of the fourth variation of the system, the user self-tests the duress pendant when entering a duress coverage area.

In a fifth variant of the fourth variation of the system, the area controller gateway determines when the duress pendant is in a specified range of a duress coverage area and dynamically registers and unregisters the duress pendant. In a variant of this, the duress pendant is adapted to be dynamically registered and unregistered in a plurality of duress coverage areas as the user moves from one duress coverage area to another duress coverage area.

In a sixth variant of the fourth variation of the system, transmission of information from, and transmission of other information to, the duress pendant is managed by an enterprise mobile duress software. There are several variations of this sixth variant of the fourth variation of the system.

In one variation of the sixth variant, the enterprise mobile duress software instructs the duress pendant to transmit information, thereby determining a current location of the duress pendant. In a variation of this, the enterprise mobile duress software instructs the duress pendant to continually transmit information to determine the current location of the duress pendant and predict a next location whenever the duress pendant is changing locations and determine a safe exit route.

In a fifth variation of the system, the mobile transponder is a duress pendant also adapted to be fixedly or removably mounted on a static object or a movable object.

Another system is similar to the first system or any of the variations discussed above, but includes a repeater adapted to receive information from the at least one mobile transponder and to transmit said information to the area controller gateway.

Another aspect is a method for transmitting information in a wireless network. The method includes multiple steps. The first step is to provide at least one mobile transponder, each transponder adapted to be on the person of a user. The second step is to provide an area controller gateway for controlling and managing the wireless network, the area controller gateway operatively connected to the at least one mobile transponder. The third step is to provide a central monitoring station adapted to receive information from the at least one mobile transponder via the area controller gateway and to transmit other information to the at least one mobile transponder via the area controller gateway. The fourth step is to transmit information from the at least one mobile transponder via the area controller gateway to the central monitoring station. The fifth step is to transmit other information to the at least one mobile transponder via the area controller gateway from the central monitoring station.

In a first variation of the method, the mobile transponder is a mobile two-way transponder. In a second variation of the method, the at least one mobile transponder includes at least one mobile one-way transponder and the method includes the further step of providing a local control and configuration device operatively connected to the at least one mobile one-way transponder.

In a third variation of the method, the area controller gateway receives an alarm from the mobile transponder and uses an algorithm to determine the location of the transponder transmitting the alarm.

In a fourth variation of the method, the mobile transponder is a duress pendant worn by the user to provide a duress coverage to the user. There are many variants of this fourth variation of the method.

In one variant of the fourth variation of the method, the duress coverage is provided at a first location and is extended to a second location and also to an area between the first location and the second location by use of at least one repeater.

In a second variant of the fourth variation of the method, the duress coverage is extended for a user traveling in a vehicle over an area surrounding the vehicle by use of an on-board GPS system, whereby information is transmitted from the vehicle to the central monitoring station by a cellular connection with a GPS location, wherein the area controller gateway is mounted on the vehicle.

In a third variant of the fourth variation of the method, the duress pendant includes an access control device and is adapted to provide a security credential.

In a fourth variant of the fourth variation of the method, the user self-tests the duress pendant when entering a duress coverage area.

In a fifth variant of the fourth variation of the method, the area controller gateway determines when the duress pendant is within a specified range of a duress coverage area and dynamically registers and unregisters the duress pendant. In a variation of this variant, the duress pendant is dynamically registered and unregistered in a plurality of duress coverage areas as a user moves from one duress coverage area to another duress coverage area.

In a sixth variant of the fourth variation of the method, transmission of information from, and transmission of other information to, a duress pendant is managed by an enterprise mobile duress software. There are several variations of this variant.

In one variation of the sixth variant of the fourth variation of the method, the enterprise mobile duress software instructs the duress pendant to transmit information, thereby determining a current location of the duress pendant. In a variation of this, the enterprise mobile duress software instructs the duress pendant to continually transmit information to determine the current location of the duress pendant and predict a next location whenever the duress pendant is changing locations and determine a safe exit route In a fifth variation of the method, the mobile transponder is a duress pendant also adapted to be fixedly or removably mounted on a static object or a movable object.

Another method is similar to the first method or any of the variations discussed above, but includes several additional steps. The first additional step is to provide a repeater adapted to receive information from the at least one mobile transponder and to transmit said information to the area controller gateway. The second additional step is to transmit information from the at least one mobile transponder to the repeater. The third additional step is to transmit said information from the repeater to the area controller gateway.

BRIEF DESCRIPTION OF THE DRAWINGS

Applicants' systems and methods will be described by way of example with reference to the accompanying drawings, in which.

DETAILED DESCRIPTION

Figure 1:
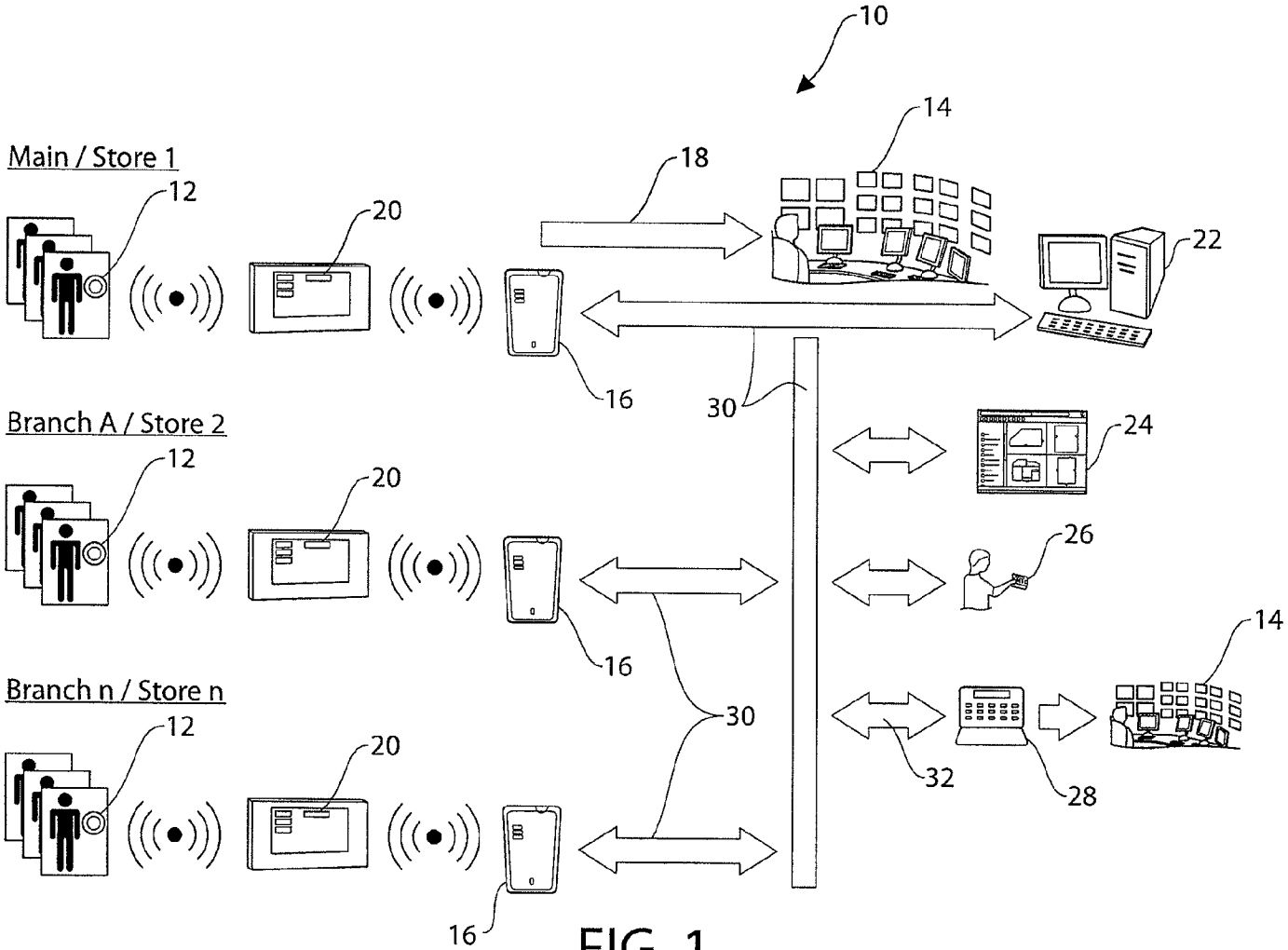
FIG. 1 is a schematic illustration of one embodiment of Applicants' system.

Applicants' systems and methods enable people to request assistance when presented with an actual, escalating or potential, duress situation by activating a wireless emergency pendant that can be worn on their person. The systems are scalable to include single sites, distributed sites, and multi-site/multi-campus facilities. One embodiment of Applicants' systems comprises a protected premise with a known perimeter, a wireless network, a duress pendant, a credential, an area controller gateway (ACG), and a hosted enterprise mobile duress software (EMDS), all residing on an information network. The system dynamically (automatically) registers the presence and/or unregisters the departure of a pendant(s) within the coverage area with the host software, and annunciates that registration or unregistration via vibration, light, sound, a combination thereof, etc. at the pendant. The ACG supervises and audits communication to pendants, determines the locations of the pendants when the alarm activation occurs, and provides notification to a central monitoring station of the pendant's status and alert condition. The ACG also communicates to the EMDS and the central monitoring station via the information network in a systematic fashion. The system provides freedom of mobility to pendant holders in organizations such as banks, convenience stores, quick serve restaurants, retail outlets, senior care or assisted living facilities, and the associated community support systems.

People to be protected can wear a mobile duress pendant on their person or, the pendant may be a fixed pendant mounted on or under a counter, dashboard of a vehicle, other equipment or other object (either fixedly mounted or removably mounted). When a person feels threatened or requires assistance, they push a button(s) on the pendant. Communications of information between the mobile duress pendant and the ACG are facilitated by a wireless network with a known perimeter. The wireless network may include multiple pendants, repeaters (if required), and the ACG.

The ACG acts as an interface between the wireless network and the information system network. The ACG also is responsible for supervision of the wireless devices on the wireless network, reporting the status of the devices (e.g., alarm, low battery, etc.), determining the location of the pendants, and communicating alarms to the central monitoring station (for monitoring alarms, etc.) and the EMDS.

When a duress alarm is transmitted by a pendant, the alarm is received by a combination of repeaters and/or the ACG. The repeaters that receive the alarm may retransmit the alarm to another repeater or directly to the ACG. When the ACG receives the alarm, it uses a novel algorithm to determine the location of the alarming pendant to room-by-room accuracy. The ACG may then send the alarm message to the central monitoring station, which will respond to the call for help and dispatch the appropriate assistance.

The EMDS assigns specific characteristics and behaviors to an individual's pendant, and also monitors the status of all the pendants and the ACG(s) in the system. EMDS is a hosted software that is accessible with authentication via a Web Browser. The EMDS is used to register a particular pendant to a particular individual.

The EMDS also will associate the ACG with a specific facility, store, branch location, or building in a multi-building setting. The ACG will provide the EMDS with the location within the store or branch location to a room-by-room accuracy if the premises has such a scale. The EMDS may send status messages, whether SMS text or email, to any wireless communications device to alert users of a status change.

Also incorporated into the pendant is an access control device, e.g., a radio frequency (RF) chip or a near-field communication device. This increases the functionality of the pendant by making it a security credential. The pendant can then be presented to a card reader which is part of an access control system to gain entry to authorized areas. This further increases the probability that an employee will bring the pendant to work, as it could be required to access and/or exit a building(s). Presentation of the pendant to an access point can initiate registration, can communicate through the access point's system connection or over the wireless network communication, and can initiate or confine the pendant to system test on registration.

The ACG employs a technique called dynamic pendant registration. When a pendant is not in range of the wireless network, it is not registered in the ACG. When a pendant comes within range of the wireless network, it starts to communicate with the ACG and notifies the user via a vibration, light, or sound indication, or some combination thereof. The ACG also notifies the EMDS, which records the status change, the time that it occurred, and the location as a traceable record. As long as the pendant is in range of the wireless network, an indicator light on the pendant can flash to indicate connectivity.

In addition, for a short period of time after the pendant comes within range of the wireless network, the person will be notified of network entry and will be required to activate the pendant in order to confirm registration and to test the system from activation through system response and notification. The ACG will see this sequence of events as a test of the pendant and the communications system. It will not be treated as an alarm and the EMDS will be notified of the event so it may be logged. If the pendant is not activated, the system will alert the appropriate authority, as the person may be in a duress situation, or may be an unauthorized pendant carrier.

When leaving the facility, once the pendant leaves the coverage area of the wireless network, the pendant will notify the person by vibration, a light, or a sound, or some combination thereof. In addition, this change of state is detected by the ACG and transmitted to the EMDS for logging.

This dynamic registration and unregistration can be repeated at any facility within the enterprise so that a qualified person carrying a pendant is automatically registered in a site when they enter the wireless network coverage area and/or present their device to an access point if used in conjunction with an access control system, and is automatically unregistered when they leave.

Since all events can be recorded by the EMDS, there can be an audit trail of where the pendant has been as well as where it is currently, as long as it is within the coverage area. The EMDS can be used to generate reports as required.

Since the pendant has an access control device in it, the pendant can be used to unlock doors to enter the protected property. Two-way communications between the access control device and the pendant controller will enable the pendant to send access status updates to the EMDS confirming entry and engagement in the network, all of which is logged.

The communications protocol between the ACG and the EMDS is defined by the physical security interoperability alliance (PSIA), an open standard and published protocol that allows the ACG and the EMDS to communicate seamlessly with other security systems, such as access control, PSIM and CCTV. This allows close communications between the access control head end and the EMDS for credential registration and tracking. In addition, the ACG will communicate with video management software to point a camera to the location of the alarm and/or increase the frame rate of the video recording.

When Applicants' systems and methods are used in the senior care market, ACGs may be installed and connected by a network connection in locations often visited by residents, in addition to the "home" location. This may include the grocery store or local bank branch, for example. This will provide the resident duress notification ability when they travel to these types of locations and facilities, or other commonly visited sites. The ACG in such facilities will communicate with a global EMDS server which has intelligence to verify that the pendant is a "shared member" of a specific facility's perimeter coverage and to find out their home location as part of the dynamic registration process. When a resident pushes the button on their pendant, the message will be routed to their home system. In addition, if an alarm takes place in the grocery store, the store manager may also be notified by a text message or preprogrammed voice call.

In large organizations with many locations and employees, it becomes very difficult to keep track of to whom each pendant is assigned, as well as the pendant's pattern of use or location. Applicants' mobile duress notification system and EMDS track and locate mobile duress pendants in an enterprise wide, multi-location environment.

Even though a pendant associated with an alarm system might be in a facility, the general location of the pendant may be unknown in conventional systems. The ACG in Applicants' systems and methods can determine the general location of pendants with room-to-room accuracy, and alerted personnel may respond more timely to events. More importantly, often when a duress button is pressed in a conventional system, the notified party only knows that somebody in the facility needs help, rather than what room the alarm was initiated. The ACG employs Applicants' algorithm to determine the location of mobile duress alarms within the facility.

Regular testing of conventional duress systems usually requires a call to the central monitoring station to advise them to ignore alarms for a given period of time as each pendant is tested. By incorporating the button push into the dynamic registration function of Applicants' systems and methods, the pendant's alarm notification function is tested each time the pendant enters the facility and is recorded without any undesired notification to the central monitoring station. A significant by-product of this test-confirm procedure is the repetitive nature that the pendant wearer adopts, helping to make the activation routine in addition to strengthening the confidence of the individual that the mobile duress system designed to protect them will actually do that in case of an actual event.

Today, most security (video, access control, and alarm) systems operate completely independently from one another. Through the deployment of PSIA and the integration of an access control device in the pendant, the EMDS can easily be integrated and operated as a complete system. Furthermore, integration of the access control device into the pendant means the user only has to carry one item, rather than an access control credential and a duress pendant.

The ACG manages and controls the wireless network. In one embodiment of Applicants' systems and methods, the ACG comprises a smart two-way radio and a microcontroller. The microcontroller is responsible for controlling the two-way radio, communications to the wireless network, determining the locations of pendants, and pendant registration.

The wireless network comprises a plurality of wireless pendants. The range of the wireless network is scalable through the use of optional repeaters. The ACG keeps track of all the pendants registered in the wireless network and reports the status of the pendants by exception to a host process connected to the ACG via Internet connection/cellular connection. Fixed wireless end points, such as motion detectors, are monitored for battery life and other off-normal conditions. It is expected that these devices are always registered to the ACG and if one of them goes missing, a trouble condition is recorded and transmitted to the host process.

Since an intrusion control panel also ignores devices not registered to the intrusion control panel, a regional manager would need a pendant for every branch visited. This also applies to bank tellers or employees who might be assigned to work in multiple branches.

All pendants within an enterprise are registered in the EMDS. When a pendant is detected by the ACG, presence of the pendant is reported to the EMDS, which then registers the device in the ACG. When the device is registered, the pendant is sent a message indicating that it is in the protected area.

The ACG also is a communications gateway. Communications to the host process are via the PSIA IP based protocol. The primary communications is a 100BaseT Ethernet connected supported by Power Over Ethernet (POE). Back up communications is provided by an optional plug-in module containing a cellular radio with data capability. This provides a wireless IP connection to the host.

Since the ACG resides on an IP network, it can be configured to communicate directly to an alarm monitoring center which can dispatch emergency responders.

Configuration of the ACG is similar to the configuration of a wireless router. This is accomplished using a web browser. Once connected, the ACG will serve WEB pages that the installer will use to make configuration choices.

In one embodiment of Applicants' systems and methods the duress pendant is a two-way transponder that can be worn by the person to be protected. For call mobile panic buttons, the pendant may have one or more push buttons (e.g., 1, 2, 3 or 4 push buttons). When the protected person wearing the pendant feels threatened, they simply push one of the buttons and the authorities are notified.

The system may be configured to provide acknowledgement feedback to the user by vibration, visual indication, audible indication, or some combination thereof once the alarm has been received and acknowledged to provide the alarm initiator with reassurance that help is on the way.

In the case of an emergency situation at a facility, when the emergency is over, the user can initiate an "all clear" command which will cause an audible indication, visual indication, vibrational indication or some combination thereof on the pendant, thereby notifying the person carrying the pendant that it is now safe.

A person wearing a pendant may be informed when they enter a network. For example, a bank employee who is responsible for opening a bank can be informed by their pendant vibrating when they approach the bank (still outside). The employee would then have some programmable period of time, say 60 seconds, to push a button to acknowledge that they are in the network. If they fail to push the button, because of a duress situation, an event notification would be sent to those who need to know that unusual activity may be taking place. The EMDS could then escalate this to a police call, if appropriate.

Requiring that the user push a button upon entering the network also solves another long-time problem. Pushing the button to confirm operation on the network fully tests the pedant, the ACG, and the EMDS without a call to the central monitoring station. Conventional systems today require a call to the central monitoring station to ask them to ignore the alarm during a test. This is a major inconvenience to the customer as all the pendants must be tested together and it usually is a weekly event. Applicants' pendant and ACG can accomplish this test every day silently in the background with a record for audit purposes.

Incorporation of an access control device into the pendant allows the pendant to also be used as an access control credential.

The EMDS is a hosted system that is comprised of a relational database, business layer software applications and web services. This functionality may be provided as a Software as a Service (SaaS), hosted in "the cloud."

Service can be provided to multiple customers. Each customer can be treated as an account and all data and logic can be completely hidden from other customers. For example, the service can be provided on a monthly subscription basis.

Each customer can access the service via a web browser. A software client would not be needed by the customer. The customer can gain access to the service via password authentication.

Individual ACG units can communicate directly with the software and can be assigned a unique customer ID. This LD may be held in each ACG and all the wireless pendants to identify the customer. This will prevent one customer's network from interfering with another customer's network.

The customer will register each pendant with the EMDS. The registration information will include the pendant serial number and the employee information. The database will use standard database communications methods so it can be easily configured to communicate with Human Resources (HR) systems, such as payroll, so that employee data only need be entered once.

ACG units will continuously update the EMDS with pendant data so that the EMDS will always know the latest location of the pendants.

When an alarm is detected, the EMDS may have a preprogrammed response and notification procedure. Notifications may be sent via a phone call, text message, or email to one user or many users. There may be an escalation procedure such that a message may be sent to a particular user and if there is no acknowledgement after a period of time, additional messages could be sent to other users, possibly including the central monitoring station used for monitoring, etc.

The EMDS may also run diagnostics on the various ACGs to determine the quality of the network communications and the state and health of the wireless devices connected to the system.

The EMDS may have a built in report generator which would allow users to build system health reports, pendant inventory reports, and pendant location reports. The reporting system may create, archive, and export reports in many common standard formats from XML to csv files. In addition, users may query the system for individual pendant assignments and locations.

The EMDS includes an algorithm that continually asks a duress pendant for its location in a building or other facility with the intention of predicting the next location(s) of the pendant and determine a safe exit route. This feature includes pendants being able to leave a "bread crumb" trail to identify path of motion and through heuristics the most likely next location point that is then predicted and monitored by the EMDS. The EMDS also may "ping" the pendant to determine its location on command through the EMDS.

For example, this can be used for an application where a school district might employ a Response Vehicle that is equipped with a number of pendants that are then issued to SWAT team members before entering a building which is covered by the Duress Network/Perimeter Coverage can then be tracked inside the building while responding to the threat. It can also be used, for example, in an elopement (wandering) application to predict the whereabouts of the said wanderer.

Use Case—Self Test:

With Applicants' systems and methods, when a user with a pendant approaches a location (e.g., bank branch) and comes into range of the mobile duress system (network), the pendant will vibrate to indicate that the user is now in the protected area. The user will have some preprogrammed time to push his button to acknowledge. By pushing the button to acknowledge coverage, the user is actually testing the pendant. A record of this acknowledgement/self test will be logged by the system software and a test report will be available. This is a significant productivity improvement for the end user, as the pendants are tested every time they enter the network, the test is automatic, and no call is required to the central monitoring station.

In addition, in the case of a bank, during an opening, the bank is vulnerable to a "morning glory" robbery. If a bank employee gets on site and comes into range of the system and is held up, they will not push the button on their pendant and the lack of a confirmation may be processed as an alarm automatically.

Use Case—Multiple Locations, Multiple Enterprise:

In conventional systems, typically the pendants are registered to the system at each location. One of the operations permitted by Applicants' dynamic pendant registration is the ability of a single pendant to register at multiple locations within an enterprise. This can be extended to outside the enterprise. An example is a bank that has Applicants' system installed in the bank's branches. The same system also could be used by many senior care facilities, which could be served by the cloud based EMDS. When a senior enters the bank, the bank's system will detect the pendant and via the network will identify the pendant. If the senior pushes the button while in the bank, the bank system will send a message to the senior home facility that their resident is at the bank and needs assistance. The bank manager could be notified as well by, for example, a message to his smart phone.

Use Case—Mobile Duress—Jewelry Delivery/Money Delivery:

Transporting precious gems, metals, and money occurs often in modern society. Some enterprises use professional armored car services that contain sophisticated vehicle tracking devices operating on a GPS network. Others rely on their ability to blend in with the surroundings in an attempt to remain anonymous. In both cases, those who transport these goods are vulnerable to attack and burglary, especially when they are away from their vehicle. This can be prevented by use of Applicants' portable mobile duress system that follows the individual, and that is integrated with a fixed enterprise mobile duress system at the place of delivery or pick-up.

Use Case—Mobile Duress Dynamic Pendant Registration and Enterprise Mobile Duress Software:

By deploying an enterprise mobile duress system that is fixed to a building or campus environment, an individual who is in possession of a duress pendent can be detected by the dynamic pendant registration feature when within range of the duress coverage area. Coverage can be extended with the use of repeaters to insure that the vehicle and any walking paths are covered in the event of a duress event.

The duress coverage area also can be extended to the vehicle if it is equipped with an ACG which would provide an area with a known perimeter of mobile duress coverage around the vehicle. In this situation, the duress signal utilizes the on-board GPS system to relay the position of the vehicle with the addition of the duress call that occurred external to the vehicle and out of range of the closest covered building or campus.

Several embodiments of Applicants' systems and methods are shown in FIGS. 1 through 4B. Persons skilled in the art will recognize that Applicants' systems may also be arranged in additional ways besides the arrangements of the embodiments illustrated in FIGS. 1 through 4B.

FIG. 1 is an illustration of one embodiment of Applicants' system 10 in an application for stores including a main store (store 1) and a number of branch stores, such as branch A (store 2) through branch n (store n). In this illustrated application there are multiple people (e.g., employees) in each store and each of them has a duress button or duress pendant 12 on their person. Each duress pendant 12 is a mobile two-way transponder having one or more push buttons which the user may push to send information to the central monitoring station 14, such as information about trouble at their location in the store. An operator in the central monitoring station 14 can receive such information transmitted from the pendant 12, and can transmit information from the central monitoring station 14 back to the pendant 12. The central monitoring station 14 also may notify the appropriate authorities.

The central monitoring station 14 is operatively connected to an area controller gateway (ACG) 16 by an internet connection or cellular connection 18. The ACG 16 controls and manages the wireless network in which Applicants' system transmits information, and is operatively connected to the duress pendants 12 worn by the users to provide duress coverage to the users.

Optional repeaters 20 may be included to receive information from the duress pendants 12 and to transmit said information to the ACG 16. The pendant management software illustrated in FIG. 1 is Applicants' enterprise mobile duress software (EMDS) 22, which assigns specific characteristics and behaviors to the users' pendants 12, and also monitors the status of all the pendants 12 and the ACG 16. The EMDS 22 also associates the ACG 16 with specific stores, branches and locations within the main store and branch stores. The EMDS also may send notifications to cell phones via SMS, email, or prerecorded messages.

As illustrated in FIG. 1, this embodiment of Applicants' system 10 may also include other features such as video management 24, access control 26, and intrusion capabilities 28, each of which communicates with the IP network 30 via an IP based protocol such as by the physical security interoperability alliance (PSIA) 32 protocol.

Figure 2:
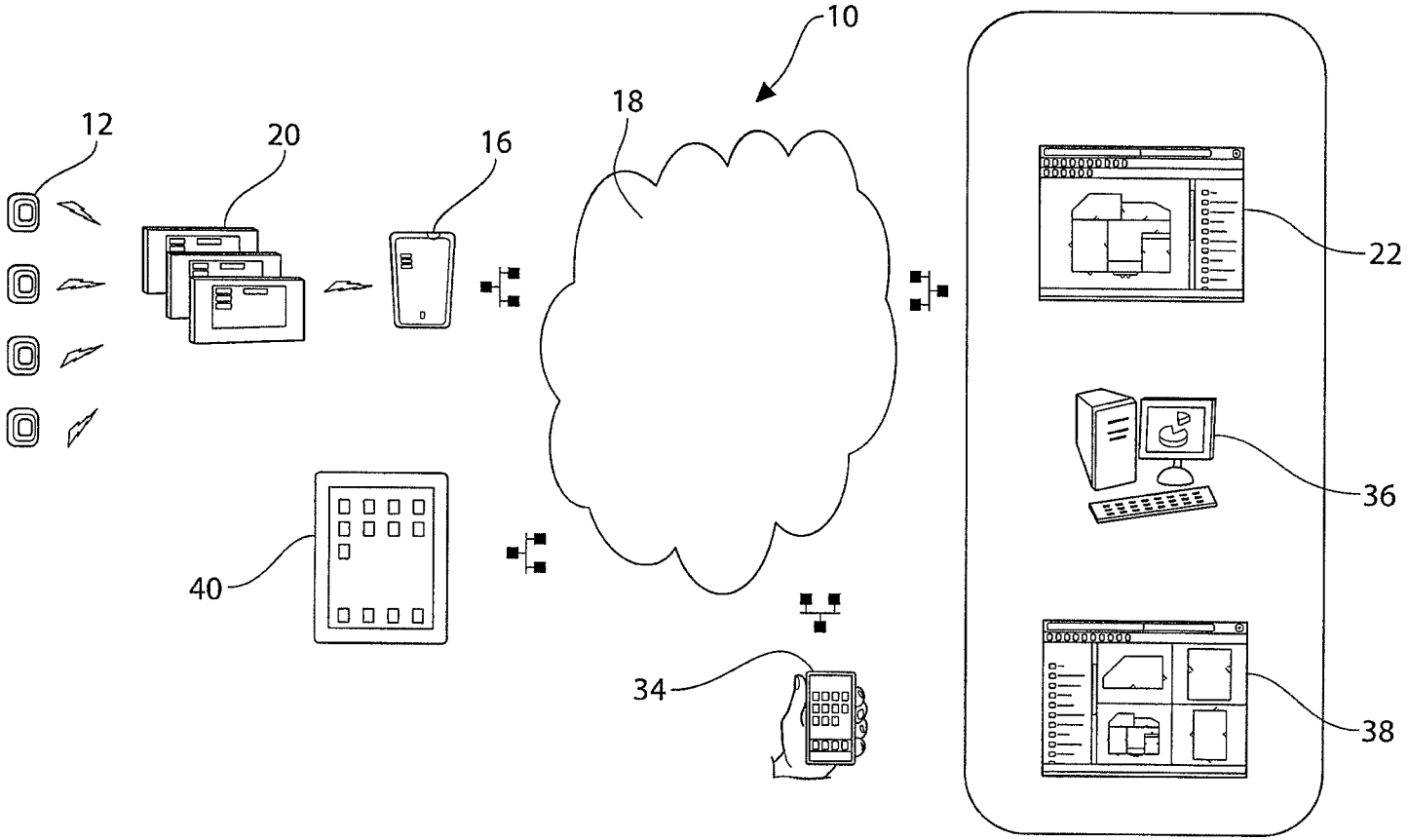
FIG. 2 is a schematic illustration of another embodiment of Applicants' system.

FIG. 2 illustrates another embodiment of Applicants' system 10. In this embodiment, multiple mobile duress pendants 12 are operatively connected to an area controller gateway (ACG) 16 or IP network coordinator. Multiple repeaters 20 receive information from the mobile duress pendants 12 and transmit said information to the ACG 16 or IP network coordinator, which is operatively connected by a wide area network or internet connection 18 to a personal communications annunciation and control 34 as well as various physical security information management systems: enterprise mobile duress software (EMDS) 22, access control systems & building management systems 36, and video management systems 38. Also included in this embodiment is a local control and configuration device 40, which allows local registration, acknowledgement, and configuration of duress pendants 12 on the system 10. In the case of one-way pendants, the local control and configuration device 40 allows the user to acknowledge the network coverage and enable a single pendant self-test feature.

Figure 3:
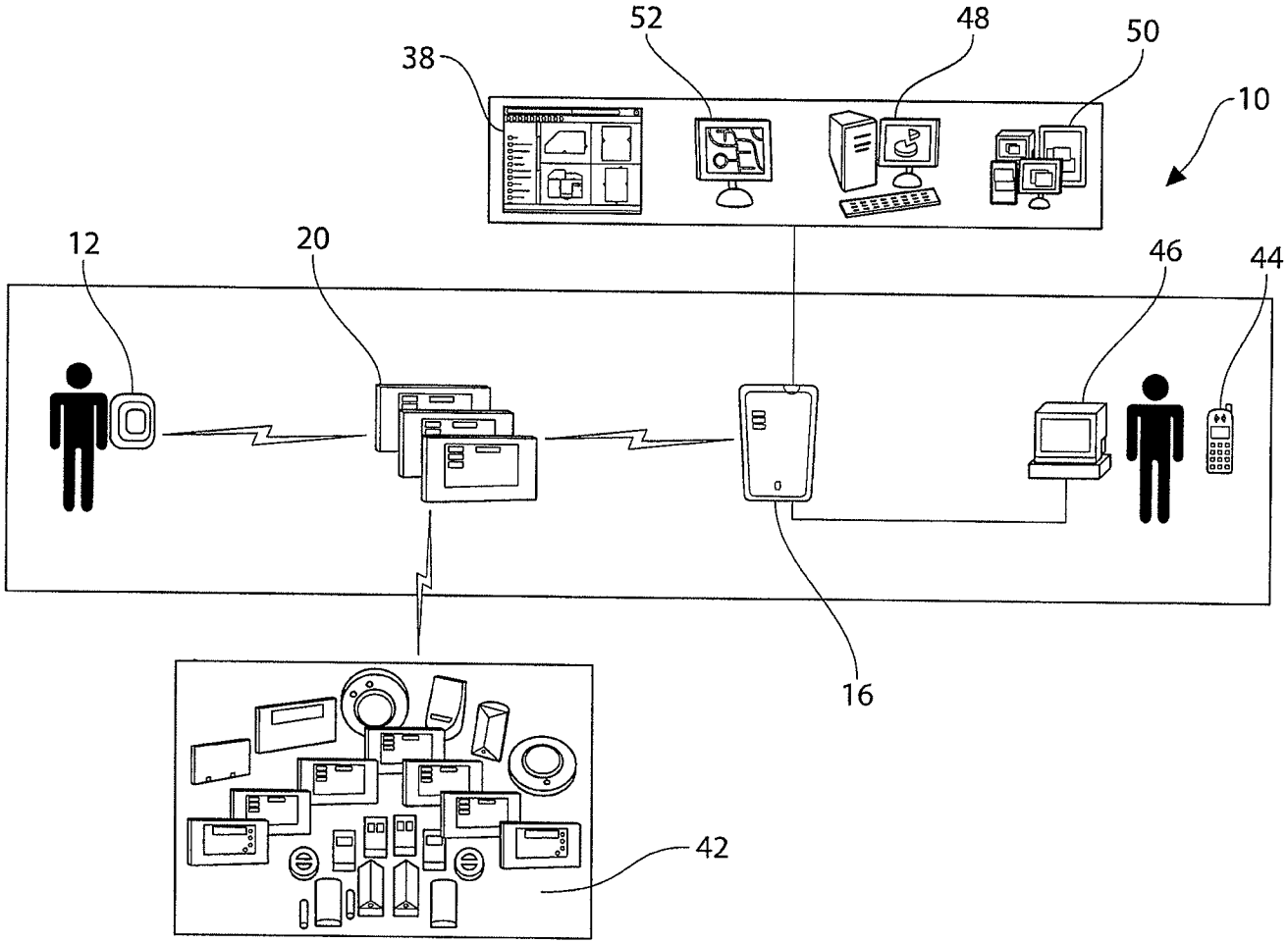
FIG. 3 is a schematic illustration of yet another embodiment of Applicants' system.

FIG. 3 illustrates another embodiment of Applicants' system 10. This illustration shows how intrusion capabilities 42 (e.g., motion detectors, monitors, sensors, etc.) may be incorporated in the system 10. Alarm and location notifications can be transmitted by various communication means, such as phone 44 or computer 46 (which runs the EMDS), via the network coordinator or ACG 16 to monitoring personnel. The system 10 also has the capability to make determinations of alarm states and locations. Other capabilities which may be integrated in the system include video management 38, access control 48, mass notification 50, and monitoring of fire protection systems 52.

Figure 4A:
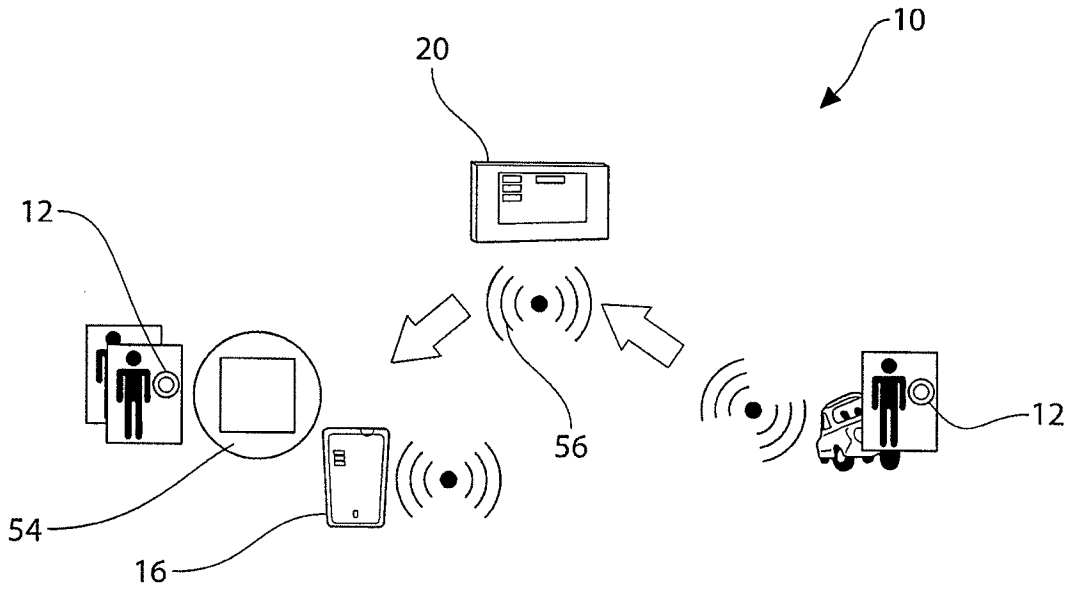
FIG. 4A is a schematic illustration of an embodiment of Applicants' system for extended coverage.

FIG. 4A illustrates an embodiment of Applicants' system 10 providing enterprise mobile duress campus coverage. Mobile duress store coverage 54 is provided in a shopping mall having multiple stores, including store 1. Mobile duress extended coverage 56 is provided to an individual wearing a duress pendant 12 in the remote parking/drop-off zone. While this individual walks from the remote parking/drop-off zone to store 1, mobile duress extended coverage 56 is provided to them along the way via the repeater 20. As with the other embodiments of Applicants' systems 10, this embodiment includes an ACG 16 and at least one repeater 20.

Figure 4B:
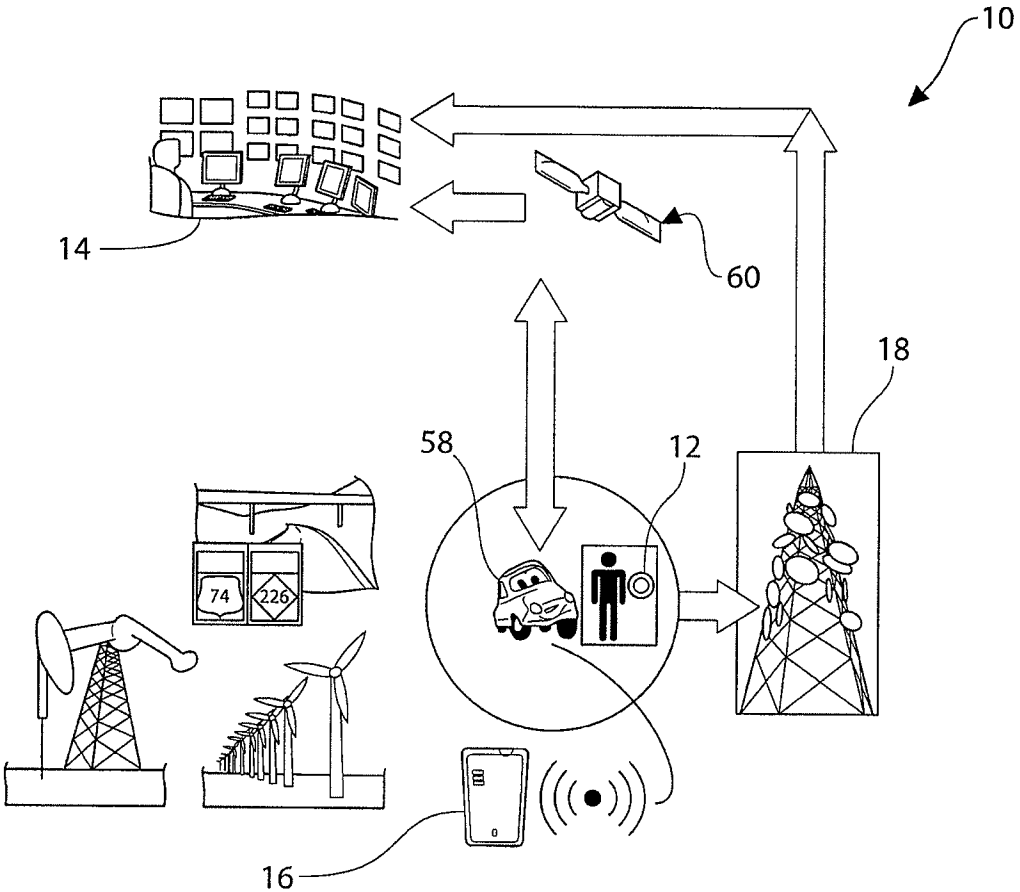
FIG. 4B is another embodiment of Applicants' system for extended coverage.

FIG. 4B illustrates an embodiment of Applicants' system 10 wherein enterprise mobile duress remote coverage is provided to a protected individual traveling in a vehicle (e.g., an automobile, or an armored car loaded with cash for bank drop off) with an on-board GPS 58. A mobile duress alarm may be routed to a central monitoring station 14 via a cellular network 18 with GPS location. In this embodiment, the ACG 16 is mounted in the vehicle. As shown in the illustration, GPS location information is transmitted to and from the vehicle via satellite 60 and said information is provided to the central monitoring station 14, which also receives information from the duress pendant 12 via the cellular network 18.

Applicants' systems and methods include many other embodiments and variations thereof which are not illustrated in the drawings or discussed in the Detailed Description section. Those embodiments and variations, however, do fall within the scope of the appended claims and equivalents thereof.

Persons skilled in the art will recognize that the embodiments and variations illustrated in the drawings and discussed in the Detailed Description section do not disclose all of the possible arrangements of Applicants' systems and methods, and that other arrangements are possible. Accordingly, all such other arrangements are contemplated by Applicants' systems and methods, and are within the scope of the appended claims and equivalents thereof.

Persons skilled in the art also will recognize that many other embodiments incorporating Applicants' inventive concepts are possible, as well as many variations of the embodiments illustrated and described herein.

Although illustrated and described herein with reference to certain specific embodiments, Applicants' systems and methods are nevertheless not intended to be limited to the details shown. Rather, various modifications may be made in the details within the scope and range of equivalents of the claims without departing from the spirit of the invention.

What is claimed is:

1. A system for transmitting information in a wireless network, comprising:

at least one mobile transponder, each transponder adapted to be on the person of a user;

an area controller gateway for controlling and managing the wireless network, the area controller gateway operatively connected to the at least one mobile transponder; and a central monitoring station adapted to receive information from the at least one mobile transponder via the area controller gateway and to transmit other information to the at least one mobile transponder via the area controller gateway, wherein the central monitoring station is operatively connected to the area controller gateway by an internet connection or a cellular connection, and wherein the at least one mobile transponder includes at least one mobile one-way transponder and the system further comprises:

a local control and configuration device operatively connected to the at least one mobile one-way transponder.

2. A system as in claim 1, wherein the mobile transponder is a duress pendant worn by the user to provide duress coverage to the user.

3. A system as in claim 2, wherein the area controller gateway determines when the duress pendant is within a specified range of a duress coverage area and dynamically registers and unregisters the duress pendant.

4. A system as in claim 3, wherein the duress pendant is adapted to be dynamically registered and unregistered in a plurality of duress coverage areas as the user moves from one duress coverage area to another duress coverage area.

5. A system for transmitting information in a wireless network, comprising:

at least one mobile transponder, each transponder adapted to be on the person of a user;

an area controller gateway for controlling and managing the wireless network, the area controller gateway operatively connected to the at least one mobile transponder; and a central monitoring station adapted to receive information from the at least one mobile transponder via the area controller gateway and to transmit other information to the at least one mobile transponder via the area controller gateway, wherein the central monitoring station is operatively connected to the area controller gateway by an internet connection or a cellular connection, and wherein the mobile transponder is a duress pendant worn by the user to provide a duress coverage to the user, and wherein the duress coverage is extended for a user traveling in a vehicle over an area surrounding the vehicle by use of an on-board GPS system, whereby information is transmitted from the vehicle to the central monitoring station by a cellular connection with a GPS location, wherein the area controller gateway is mounted on the vehicle.

6. A system as in claim 5, wherein the mobile transponder is a mobile two-way transponder.

7. A method for transmitting information in a wireless network, comprising the steps of:

providing at least one mobile transponder, each transponder adapted to be on the person of a user;

providing an area controller gateway for controlling and managing the wireless network, the area controller gateway operatively connected to the at least one mobile transponder;

providing a central monitoring station adapted to receive information from the at least one mobile transponder via the area controller gateway and to transmit other information to the at least one mobile transponder via the area controller gateway;

transmitting information from the at least one mobile transponder via the area controller gateway to the central monitoring station; and transmitting other information to the at least one mobile transponder via the area controller gateway from the central monitoring station, wherein the at least one mobile transponder includes at least one mobile one-way transponder and the method comprises the further step of:

providing a local control and configuration device operatively connected to the at least one mobile one-way transponder.

8. A method as in claim 7, wherein the mobile transponder is a duress pendant worn by the user to provide duress coverage to the user.

9. A method as in claim 8, wherein the area controller gateway determines when the duress pendant is within a specified range of a duress coverage area and dynamically registers and unregisters the duress pendant.

10. A method as in claim 9, wherein the duress pendant is adapted to be dynamically registered and unregistered in a plurality of duress coverage areas as the user moves from one duress coverage area to another duress coverage area.

11. A method for transmitting information in a wireless network, comprising the steps of:

providing at least one mobile transponder, each transponder adapted to be on the person of a user;

providing an area controller gateway for controlling and managing the wireless network, the area controller gateway operatively connected to the at least one mobile transponder;

providing a central monitoring station adapted to receive information from the at least one mobile transponder via the area controller gateway and to transmit other information to the at least one mobile transponder via the area controller gateway;

transmitting information from the at least one mobile transponder via the area controller gateway to the central monitoring station; and transmitting other information to the at least one mobile transponder via the area controller gateway from the central monitoring station, wherein the mobile transponder is a duress pendant worn by the user to provide a duress coverage to the user, and wherein the duress coverage is extended for a user traveling in a vehicle over an area surrounding the vehicle by use of an on-board GPS system, whereby information is transmitted from the vehicle to the central monitoring station by a cellular connection with a GPS location, wherein the area controller gateway is mounted on the vehicle.

12. A method as in claim 11, wherein the mobile transponder is a mobile two-way transponder.

13. A system for transmitting information in a wireless network, comprising:

at least one mobile transponder, each transponder adapted to be on the person of a user;

an area controller gateway for controlling and managing the wireless network, the area controller gateway operatively connected to the at least one mobile transponder; and a central monitoring station adapted to receive information from the at least one mobile transponder via the area controller gateway and to transmit other information to the at least one mobile transponder via the area controller gateway, wherein the central monitoring station is operatively connected to the area controller gateway by an internet connection or a cellular connection, and wherein the mobile transponder is a duress pendant worn by the user to provide a duress coverage to the user, and wherein transmission of information from, and transmission of other information to, the duress pendant is managed by an enterprise mobile duress software, and wherein the enterprise mobile duress software instructs the duress pendant to transmit information, thereby determining a current location of the duress pendant, and wherein the enterprise mobile duress software instructs the duress pendant to continually transmit information to determine the current location of the duress pendant and predict a next location whenever the duress pendant is changing locations and determine a safe exit route.

14. A system as in claim 13, wherein the mobile transponder is a mobile two-way transponder.

15. A method for transmitting information in a wireless network, comprising the steps of:

providing at least one mobile transponder, each transponder adapted to be on the person of a user;

providing an area controller gateway for controlling and managing the wireless network, the area controller gateway operatively connected to the at least one mobile transponder;

providing a central monitoring station adapted to receive information from the at least one mobile transponder via the area controller gateway and to transmit other information to the at least one mobile transponder via the area controller gateway;

transmitting information from the at least one mobile transponder via the area controller gateway to the central monitoring station; and transmitting other information to the at least one mobile transponder via the area controller gateway from the central monitoring station, wherein the mobile transponder is a duress pendant worn by the user to provide a duress coverage to the user, and wherein transmission of information from, and transmission of other information to, the duress pendant is managed by an enterprise mobile duress software, and wherein the enterprise mobile duress software instructs the duress pendant to transmit information, thereby determining a current location of the duress pendant, and wherein the enterprise mobile duress software instructs the duress pendant to continually transmit information to determine the current location of the duress pendant and predict a next location whenever the duress pendant is changing locations and determine a safe exit route.

16. A method as in claim 15, wherein the mobile transponder is a mobile two-way transponder.

* * * * *